United States Patent [19]

Moretti

[11] 4,455,683

[45] Jun. 26, 1984

[54] SELF-ADJUSTING PROTECTIVE GARMENT

[75] Inventor: Anthony L. Moretti, San Rafael, Calif.

[73] Assignee: E.D. Bullard Company, Sausalito, Calif.

[21] Appl. No.: 362,881

[22] Filed: Mar. 29, 1982

[51] Int. Cl.[3] ..... A41D 13/00

[52] U.S. Cl. ..... 2/2; 2/2.1 A; 2/DIG. 1; 441/103

[58] Field of Search ..... 2/DIG. 1, 2.1 A, 2, 2/6, 406, 407; 128/201.23, 201.28, 201.29; 112/121.26, 262.1; 441/103

[56] References Cited

U.S. PATENT DOCUMENTS

| | | | |
|---|---|---|---|
| 1,477,856 | 12/1923 | Toeppen | 2/DIG. 1 |
| 1,705,888 | 3/1929 | Aud | 441/103 |
| 1,706,097 | 3/1929 | Aud | 441/103 |
| 2,410,632 | 11/1946 | Colley et al. | 2/2.1 A |
| 4,236,514 | 12/1980 | Moretti | 2/2.1 A |
| 4,271,833 | 6/1981 | Moretti | 2/DIG. 1 |

FOREIGN PATENT DOCUMENTS

| | | | |
|---|---|---|---|
| 2269310 | 1/1976 | France | 2/2.1 A |
| 2055287 | 3/1981 | United Kingdom | 2/2.1 A |

*Primary Examiner*—Louis Rimrodt
*Attorney, Agent, or Firm*—Robert W. Dilts

[57] ABSTRACT

An air-tight self-adjusting protective garment having a torso covering portion with integral arms and legs. Gloves are sealingly affixed to the free ends of the arms and boots are sealingly affixed to the free ends of the legs. A head enclosing hood or helmet is sealingly attached to the garment, and hood and garment are supplied with a positive pressure air plenum which is exhausted through one or more one-way valves. The garment is prevented from ballooning due to the internal air pressure by a plurality of elastic strip members which are affixed to the inner surface of the garment without destroying the air-tight integrity thereof and extend longitudinally of the torso covering portion and of the arms and legs thereof, which elastic strip members also enable the garment to self-adjust to fit a range of different size individuals.

10 Claims, 8 Drawing Figures

SELF-ADJUSTING PROTECTIVE GARMENT

FIELD OF THE INVENTION

This invention relates to air tight protective clothing of the type which includes boots and gloves and is supplied with air to establish a positive air pressure therewithin and more particularly to such a suit or garment which will automatically adjust to fit users of a range of different sizes.

BACKGROUND OF THE INVENTION

It is known in the prior art to provide protective clothing or garments for persons required to work in the presence of toxic materials and gases. In order to provide full protection such garments include an air tight covering for the torso of the user with integral air tight arm and leg portions. The arm portions have air tight gloves sealingly affixed at the free ends thereof and the legs have air tight boots sealingly affixed at the free ends thereof. An air tight head covering hood or helmet is sealingly affixed to the garment about a neck opening in the torso covering portion. Air is supplied to the interior of the garment under pressure both for respiration by the user and to establish a positive pressure air plenum which is exhausted to the atmosphere to carry off exhaled air, heat and perspiration while preventing entry of toxic gases and materials.

In the prior art it was necessary to tailor such a garment to fit one particular user since if the garment is too small for the user in any of its dimensions it will be at least uncomfortable, if not unwearable, and if it is too large in any of its dimensions it will tend to balloon about the body of the user due to the positive air pressure inside the suit. The ballooning of a protective garment which is too large for the user will seriously interfere with the normal activities of the user.

It is the object of this invention to overcome the above disadvantages of the prior art.

SUMMARY OF THE INVENTION

This invention provides an improvement in protective garments having a generally tubular torso covering portion with a neck opening and generally tubular arm and leg covering portions formed integrally therewith, and with gloves and boots sealingly affixed to the free ends of the arm and leg portions respectively. Such improvement is obtained by affixing elastic strip members to the inner surface of the generally tubular torso covering portion longitudinally thereof with the elastic strip members in an expanded state, affixing elastic strip members to the inner surface of each of the generally tubular arm portions longitudinally thereof with the strip members in an expanded state and affixing elastic strip members to the inner surface of each of the generally tubular leg portions longitudinally thereof with the elastic strip members in an expanded state. The elastic strip members of the arm and leg portions may be attached to the ends or form extensions of the elastic strip members of the torso portion. In the preferred embodiment a pair of first elastic strip members each extend from the free end of a different arm portion over the shoulder to the neck opening, a pair of second elastic strip members each extend from the free end of a different arm portion at the inside thereof to the armpit and down the side of the torso covering portion and outside of a corresponding leg portion to the free end thereof, a third elastic strip member extends from the free end of one leg portion at the inside thereof to the crotch and then down the other leg portion at the inside thereof to its free end, a fourth pair of elastic strip members each extend along the front of a different leg portion and of the torso covering portion to the neck opening and a fifth pair of elastic strip members each extend along the back of a different leg portion and of the torso covering portion to the neck opening.

BRIEF DESCRIPTION OF THE DRAWING

This invention will be more fully understood from the following detailed description of preferred embodiments when read in conjunction with the appended drawing wherein.

DETAILED DESCRIPTION OF PREFERRED EMBODIMENTS

Figure 1:
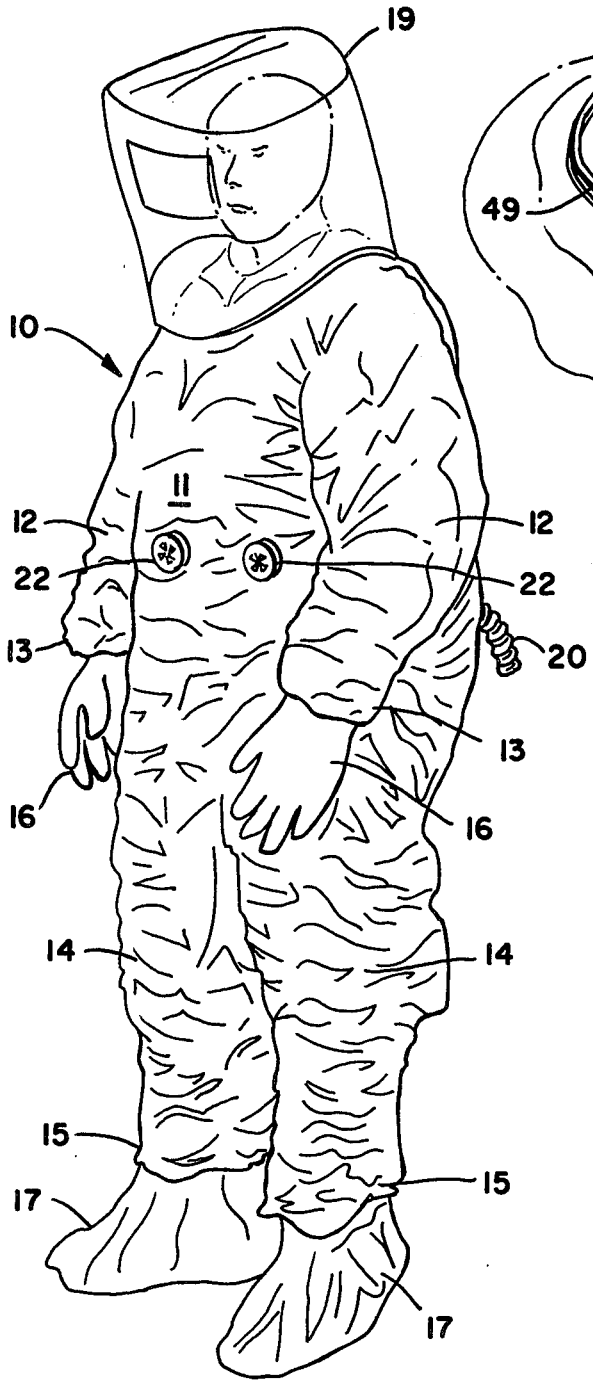
FIG. 1 is a perspective view of an individual wearing a self-adjusting protective garment in accordance with a preferred embodiment of this invention.

Referring to FIG. 1, a perspective view of an individual wearing a self-adjusting protective garment 10 according to a preferred embodiment of this invention is shown. It will be seen that the garment 10 includes a generally tubular torso covering portion 11. A pair of generally tubular arm covering portions 12, having one end formed integrally with the torso covering portion 11, extend to free ends 13. Similarly, a pair of generally tubular leg covering portions 14 are formed integrally with the torso covering portion 11 and extend to free ends 15.

Figure 6:
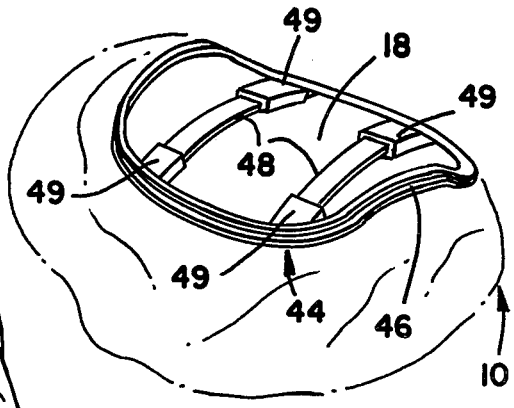
FIG. 6 is an enlarged fragmentary perspective view of the neck opening of a self-adjusting protective garment according to the teaching of this invention including a shoulder support structure in accordance with a preferred embodiment thereof.
Figures 2, 3, 4, 5:
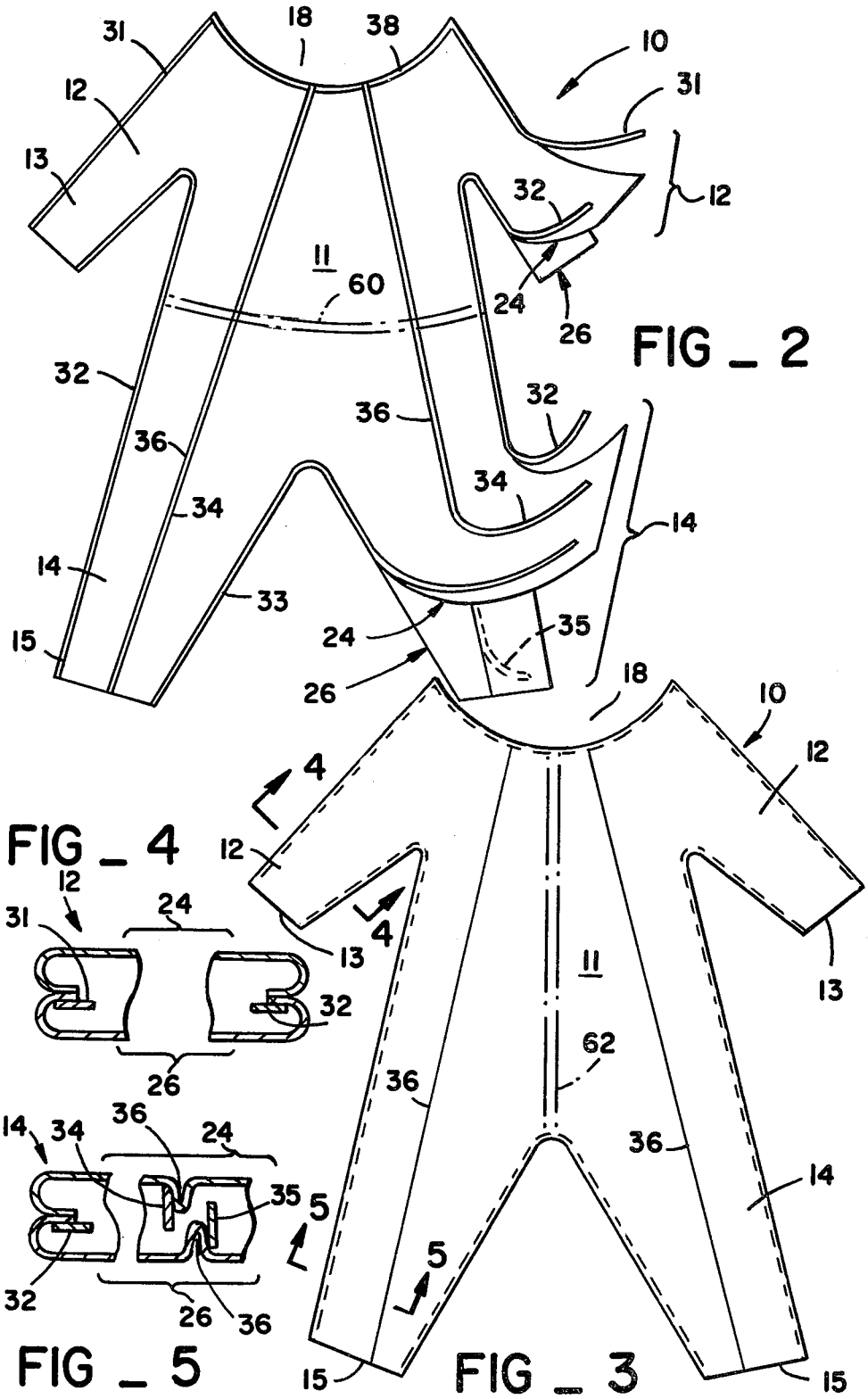
FIG. 2 is a plan view of a pair of superimposed front and back panels used in fabricating a self-adjusting protective garment according to a preferred embodiment of this invention with the free end of an arm portion and the free end of a leg portion of the front panel folded upwardly to expose a lower panel, with the elastic strip members according to the invention shown partially detached.
FIG. 3 is a plan view similar to FIG. 1 but showing the garment in condition for use and prior to attachment of gloves, boots and hood or helmet.
FIG. 4 is an enlarged fragmentary cross-sectional view taken along line 4—4 of FIG. 3.
FIG. 5 is an enlarged fragmentary cross-sectional view taken along line 5—5 of FIG. 3.

A pair of gloves 16 are sealingly affixed to the free ends 13 of the arm portions 12 and a pair of boots 17 are sealingly affixed to the free ends of the leg portions 14. As best shown in FIGS. 2, 3 and 6, the torso covering portion 11 is provided with a neck opening 18 and as shown in FIG. 1, an appropriate hood or helmet means 19 is sealingly affixed about the neck opening 18.

A supply of positive pressure air is connected to the interior of the garment 10 and hood 19 by means of a flexible hose 20 which may be sealed to the back of the garment 10, as is well known in the art. One or more one-way valve structures 22 may be sealed through openings in the front of the suit, for example, as shown in FIG. 1, to enable a flow of air out of the garment to carry away heat and perspiration as well as exhaled air from the hood 19 which is normally maintained at a higher air pressure than the interior of the garment 10 and communicates therewith.

Referring to FIG. 2, the self-adjusting protective garment 10 according to the teaching of this invention is made by cutting identical front 24 and back 26 panels from an air impervious sheet or composite fabric. For example, the front 24 and back 26 panels may be cut from a 13 mil thick sheet of nylon fabric coated with polyvinylchloride to make it air-tight.

Each of the panels 24 and 26 is dimensioned and shaped to provide one-half of the tubular torso, arm and leg covering portions of the garment 10. In other words, each of the panels 24 and 26 comprises a main body portion in the form of a truncated triangle which will constitute one-half of the tubular torso covering portion 11 of the finished garment 10. Such truncated triangular body portion of each panel 24 and 26 has an altitude dimension which is larger than the crotch to shoulder length of the largest individual expected to wear the garment 10. Similarly, the transverse dimension parallel to the base of the truncated triangular body portion of each panel about midway between the base and truncated apex thereof is larger than one-half of the girth of the largest individual expected to wear the garment 10. The base angles of the truncated triangular main body portion preferably exceed 75° and may approach 90°.

The arm 12 and leg 14 covering portions of each panel 24, 26 are formed integrally with the main body portion thereof. Thus, the leg covering portions 14 of each panel 24 and 26 extend from the base of the truncated triangular main body portion and may have an outer edge which forms an extension of the outer edge of the main body portion. The inner edges of the leg portions 14 meet at the base of the truncated triangular main body portion to define a crotch and diverge from each other toward their free ends 15 at an acute angle, which may be about 30°, for example. The length of each leg covering portion 14 of each panel 24, 26 from crotch to the free end thereof is larger than the length of the leg from crotch to ankle of the largest individual expected to wear the garment 10 and the width of the leg covering portion 14 of each panel 24, 26 is chosen to be large enough to pass the foot of the largest individual expected to wear the garment 10 when the leg portions 14 of the two panels 24, 26 are joined to each other along their edges, as will be more fully described hereinafter.

Similarly, the arm portions 12 of each panel 24, 26 are formed integrally with the sides of the truncated triangular main body portion at the truncated apex thereof. The arm covering portions 12 of each panel 24, 26 may each comprise a generally rectangular figure having a length dimension extending at an angle of about 20° with respect to the sides of the truncated triangular main body portion and with one corner therof merging into the side of the truncated triangular main body portion. Thus, the lower edge of each arm covering portion 12 of each panel forms an armpit angle with the truncated triangular main body portion and the upper edge of each arm portion 12 of each panel 24, 26 merges into the truncated triangular main body portion to provide a shoulder engaging portion. The length of the arm portions 12 of each panel 24, 26 from the armpit to the free end thereof is larger than the length of the arm from armpit to wrist of the largest individual expected to wear the garment 10 and the width of the arm portions 12 of the panels 24, 26 is sufficient to loosely surround the arm of the largest individual expected to wear the garment when the arm portions 12 of the two panels 24, 26 are joined along their edges as will be described more fully hereinafter.

The truncated apex of the panels 24 and 26 are preferably cut to define a concave semi-circular apex which will form the boundaries of the neck opening 18 of the garment 10 as will be more fully described hereinafter. Thus, the garment 10 is formed by superimposing the two panels 24 and 26 on each other as shown in FIG. 2 and heat sealing the edges of the panels 24 and 26 to each other except at the free ends 13 of the arm portions 12, the free ends of the leg portions 14 and at the periphery of the neck opening 18. After such heat sealing is accomplished, the garment 10 may be turned inside out by pulling the arms, legs and body portion through the neck opening 18 so that the heat sealed edges project into the interior of the garment 10 as best shown in FIGS. 3, 4 and 5.

According to the teaching of this invention, a plurality of elongated elastic strips are attached to the garment 10 after the edges thereof are sealed together as shown in FIG. 2 and before it is turned inside out as shown in FIGS. 3, 4 and 5. Thus, a pair of first elastic strip members 31 are each stretched to an expanded state and attached along their length to the sealed edges at the outside of a different one of the arm portions 12 of the garment 10 from the free end 13 of the arm portion 12 to the neck opening 18. Similarly, a pair of second elastic strip members 32 are each stretched to an expanded state and attached to the sealed edge portions along the inside of a different arm portion 12 from the free end 13 thereof to the armpit, along the side of the torso covering portion 11 and the outside of the corresponding leg portion 14 to the free end 15 thereof. A third elastic strip member 33 is stretched to an expanded state and attached along its expanded length to the sealed edges at the inside of the leg portions 14 from the free end 15 of one leg portion to the crotch and from the crotch to the free end 15 of the other leg portion 14.

Also according to the teaching of this invention, a pair of fourth elastic strip members 34 are each stretched to an expanded state and attached along the expanded length thereof to the front panel 24 of the garment 10 from the free end 15 of a different leg portion 14 to the neck opening 18. The fourth elastic members 34 are preferably located midway between the edges of the leg portions 14 and extend generally parallel to the outside edge of the garment 10 to the neck opening 18. Similarly, a pair of fifth elastic members 35 are each stretched to an expanded state and attached along their expanded length to the back panel 26 from the free end 15 of a different leg portion to the neck opening 18. Again, the fifth elastic strip members are preferably located midway between the edges of the leg covering portions 14 and extend generally parallel to the adjacent outside edge of the garment 10.

According to the teaching of this invention, the elastic members are attached to the garment 10 in such a way as to maintain the air-tight integrity of the garment 10. Thus the first, second and third elastic members may be sewn to the sealed edges of the garment 10 along a line which is fully contained within the sealed edge areas. Similarly, the front 24 and back 26 panels of the garment 10 as shown in FIG. 2 may be creased to provide an outwardly projecting fold 36 the adjacent sides of which are then heat-sealed together to enable the attachment of the fourth and fifth elastic members thereto by sewing along a line fully contained in the sealed area, for example, without destroying the air-tight integrity of the garment 10.

Thus, referring to FIGS. 3, 4 and 5, after the front 24 and back 26 panels have been sealed to each other and the elastic strip members 31, 32, 33, 34 and 35 attached thereto, garment 10 is turned inside out to its normal wearing condition. Thus, the sealed edges and elastic strip members are positioned as shown in cross section in FIGS. 4 and 5 when the garment 10 is worn in use. It will be understood that the elastic strip members 31–35 will return to their unexpanded state causing the front 24 and back 26 panels of the garment to wrinkle and contract. In certain preferred embodiments of this invention the edge of the front 24 and back 26 panels at the neck opening 18 may be folded over and heat sealed so that a further elastic strip member 38 may be attached about the neck opening 18 as by sewing it to the folded and heat-sealed edge. This will tend to provide firm engagement of the garment 10 with the shoulders of the individual wearing the garment 10.

Referring to FIGS. 1 and 6, a head enclosure, hood or helmet 19 is sealingly affixed to the garment 10 at the neck opening 18 thereof. In a preferred embodiment of this invention, the head enclosure 19 may be of the type disclosed in U.S. Pat. No. 4,236,574, issued Dec. 2, 1980, to Anthony L. Moretti, the teaching of which is incorporated herein by reference. Thus, as best shown in FIG. 6, an annulus 44 having an exterior circumferentially extending groove 46 therein is inserted into the neck opening 18 of the garment 10. The annulus 44 has a saddle-like configuration and is made of rigid lightweight material such as plastic or aluminum. An elastic strip member 38 about the periphery of the neck opening 18 may be sealingly received in the groove 46, or alternatively, the periphery of the neck opening 18 may be sealed in the groove 46 of the annulus 44 together with the skirt of the head enclosure, as disclosed in the above-mentioned U.S. Pat. No. 4,236,514.

According to the teaching of this invention, a pair of shoulder engaging straps 48 extend transversely across the annulus 44, as shown in FIG. 6. Cushion members 49 may be mounted on such straps 48 to enhance the comfort of the individual wearing the garment 10 in view of the tension forces exerted on the shoulders by the garment 10, as more fully disclosed below.

Pressurized air supplied to the garment 10 through the hose 20 may be distributed to the head enclosure 19 and to the arm 12 and leg 14 portions as taught in U.S. Pat. No. 4,271,833, issued June 9, 1981, to Anthony L. Moretti, the teaching of which is incorporated herein by reference. However, other air distribution systems may also be used to provide the desired positive air pressure plenum within the garment and head enclosure 19.

Figure 7:
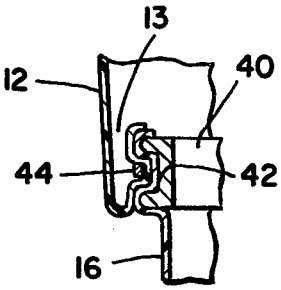
FIG. 7 is an enlarged fragmentary cross-sectional view showing a structure suitable for sealingly affixing gloves and boots to the free ends of the arm and leg portions respectively of a self-adjusting protective garment according to the teaching of this invention.

Referring to FIGS. 1 and 7, gloves 16 and boots 17 are sealingly affixed to the free ends 13 and 15 of the arm portions 12 and leg portions 14, respectively, of the garment 10 according to the teaching of this invention. The gloves 16 and boots 17 may be integrally attached to the arm portions 12 and leg portions 14, respectively, as shown in FIG. 1. Alternatively, the gloves 16 and boots 17 may be removably attached to the free ends 13 and 15 of the arm portions 12 and leg portions 14, respectively, in an air-tight manner as shown in FIG. 7. Thus, as shown in FIG. 7, a rigid ring 40 having a channel 42 formed in its outer periphery may be inserted in the cuff of each glove 16. The free end 13 of each arm portion may be folded inwardly thereof and the cuff of the glove 16 with the ring 40 in place inserted into the free end of the arm portion 12. A sealing ring 43 placed inside the fold in the free end 13 of the arm portion 12 and received in the channel 42 of the ring 40 under tension may be used to removably seal the cuff of the glove to the free end 13 of the arm portion 12. It will be understood that the ring 40 is made large enough to pass the hand of the individual wearing the garment 10. Similar but somewhat larger rings 40 dimensioned to pass the feet and shoes of the individual wearing the garment may be used to removably affix and seal the boots 17 to the free ends 15 of the leg portions 14 in the same way.

According to the teaching of this invention, the elastic strip members have unexpanded lengths which are shorter than the lengths of the arms, legs and torso of the smallest person expected to wear the garment 10. Thus, the elastic bands will be stretched when the garment 10 is worn by an individual within the size range for which the garment is designed. The stretching forces will be exerted between the shoulders and hands and between the shoulders and feet of the individual wearing the garment. Applicant has found that the resulting tensional forces are not uncomfortable even for the largest size individual when wearing the garment. In fact, applicant has found that the individuals appreciate the firm contact provided between the gloves 16 and their hands and between the boots 17 and their feet due to the tension forces overcoming the positive air pressure within the gloves and boots.

The distributed tensional forces in the elastic members 31–35 prevent the garment 10 from ballooning under the influence of the air pressure therewithin. In the preferred embodiment of this invention, the elastic strip members 31–35 and 38 were made of three-quarter inch wide elastic webbing of the type sold by J. P. Stevens Company, Inc. under Part No. N3-5530DC Natural. Applicant has used elastic webbing of this type having a width from one-half inch to one inch with success in fabricating the improved garment of this invention.

Figure 8:
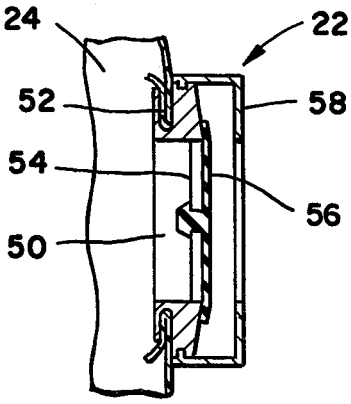
FIG. 8 is an enlarged fragmentary cross-sectional view showing a one-way exhaust valve suitable for use in a self-adjusting protective garment according to the teaching of this invention.

Referring to FIG. 8, a typical structure for the one way exhaust valves 22 is shown. Such structure includes a ring member 50 having a peripheral groove 52 into which the edge of a hole through the front panel 24 of the garment 10 is sealed. The ring includes a plurality of web members 54 extending thereacross and supporting a flexible valve member 56 of rubber or the like. As shown in FIG. 8, valve member 56 is centrally mounted on the web members 54 and defines an air impervious disc adapted to sealingly engage the exterior surface of the ring 50 about the outer periphery of the valve member 56. The valve member 56 is designed to be rigid enough to maintain a given pressure within the garment 10 and to bend outwardly at its periphery to release air at pressures higher than the given pressure. An appropriate apertured cap or cover 58 protects the valve member 56 from exterior mechanical forces.

The rigidity of the valve member 56 and the tension forces in the elastic members 31–35 are selected for a given air pressure within the garment 10 to minimize any ballooning of the garment 10 which might otherwise occur at such given air pressure. Thus, the garment 10 may be worn by any individual having a size within a given range of sizes without discomfort and without undesirable ballooning of the garment 10.

Referring to FIGS. 2 and 3, the garment 10 may be provided with chemical-proof zipper means to facilitate the donning and removal of the garment 10. As indicated by the dotted line 60 in FIG. 2, such chemical-proof zipper may divide the garment 10 into jacket and pants portions according to this invention provided that the zipper 60 must not function as a belt about the waist of the individual wearing the garment. Similarly, as indicated by the dotted line 62 in FIG. 3, the chemical-proof zipper may provide a fly type opening in the front 24 or back 26 panel of the garment 10.

It is believed that those skilled in the art will make obvious modifications in the preferred embodiments of this invention shown in the drawing, without departing from the scope of this invention as defined in the claims hereof.

What is claimed is:

1. In an air tight protective garment made of air impervious thin sheet material for use at ground level having a generally tubular torso covering portion with a neck opening and with a pair of generally tubular arm portions and a pair of generally tubular leg portions formed integrally therewith, said neck opening having an air tight head enclosure sealingly affixed about the edge thereof, said pair of arm portions each having a different one of a pair of glove members sealingly fixed to the free end thereof, said pair of leg portions each having a different one of a pair of boot members sealingly fixed to the free end thereof, an air conduit supplying a positive air plenum through a wall of said garment and a one-way air exhaust means provided through a wall of said garment, the improvement comprising a plurality of elastic strip members affixed in an expanded state to the inner surface of said generally tubular torso covering portion and extending longitudinally thereof from said neck opening to said generally tubular leg portions, a plurality of elastic strip members affixed in an expanded state to the inner surface of each of said pair of arm portions and extending longitudinally from said free end thereof to said tubular torso covering portion, and a plurality of elastic strip members affixed in an expanded state to the inner surface of each of said pair of leg portions and extending longitudinally from the free end thereof to said tubular torso covering portion.

2. The improved air tight protective garment of claim 1 wherein an annulus of rigid lightweight material is provided at said neck opening, said edge of said neck opening being sealingly affixed to an annular surface of said annulus and said head enclosure being sealingly affixed to an annular surface of said annulus.

3. The improved air tight protective garment of claim 1 wherein a pair of ring members made of rigid light weight material are each provided at the free end of a different one of said pair of arm portions with an annular surface thereof sealingly affixed to said free end of said arm portion, each of said pair of gloves being sealingly affixed to an annular surface of a different one of said pair of ring members.

4. The improved air tight protective garment of claim 1 wherein a pair of ring members made of rigid light weight material are each provided at the free end of a different one of said pair of leg portions with an annular surface thereof sealingly affixed to said free end of said leg portion, each of said pair of boots being sealingly affixed to an annular surface of a different one of said pair of ring members.

5. The improved air tight protective garment of claim 1 wherein said garment is made of thirteen mil thick nylon fabric coated with polyvinylchloride and said elastic strips are made from elastic webbing between one-half and one inch wide.

6. The improved air tight protective garment of claim 5 wherein a first pair of inward folds are provided each extending rectilinearly from said neck opening and along the front of a different one of said leg portions to said free end thereof, the adjacent surfaces of each of said folds being heat sealed to each other and each of a first pair of elastic strip members is affixed in an expanded state to the sealed area of a different one of said pair of folds.

7. The improved air tight protective garment of claim 6 wherein a second pair of inward folds are provided each extending rectilinearly from said neck opening and along the back of a different one of said leg portions to said free end thereof, the adjacent surfaces of said folds being heat sealed to each other, and each of a second pair of elastic strip members is affixed in an expanded state to the sealed area of a different one of said pair of folds.

8. In an air tight protective garment having a generally tubular torso covering portion with a neck opening and with a pair of generally tubular arm portions and a pair of generally tubular leg portions formed integrally therewith, said arm portions each having a different one of a pair of glove members sealingly fixed to the free end thereof and said leg portions each having a different one of a pair of boot members sealingly fixed to the free end thereof; the improvement comprising a pair of first elastic strip members each attached along the length thereof in an expanded state to the inner surface of a different one of said pair of tubular arm portions at the outside of the arm portion and extending from the free end thereof to said neck opening; a pair of second elastic strip members each extending along the inner surface of a different one of said tubular arm portions at the inside of said arm portion from the free end thereof to the armpit along the inner surface of said tubular torso covering portion at the side thereof from the armpit to a different one of said pair of tubular leg portions and along the inner surface of the tubular leg portion at the outside thereof to the free end thereof, said second elastic strip members being attached along their length in an expanded state to said inner surface of said arm, torso and leg portions; a third elastic strip member extending along the inner surface of one of said pair of tubular leg portions at the inside thereof from the free end thereof to the crotch and from the crotch to the free end of the other of said pair of tubular leg portions along the inner surface and at the inside thereof; said third elastic strip member being attached along its length in an expanded state to said inner surface of said leg portions; a pair of fourth elastic strip members each extending along the inner surface of a different one of said leg portions and along the inner surface of said torso covering portion at the front thereof from the free end of the leg portion to said neck opening, said fourth elastic strip members being attached along their lengths in an expanded state to the inner surface of said leg and torso portions; and a pair of fifth elastic strip members each extending along the inner surface of a different one of said leg portions and along the inner surface of said torso covering portion at the back thereof from the free end of the leg portion to said neck opening, said fifth elastic strip members being attached along their lengths in an expanded state to the inner surface of said leg and torso portions.

9. In an air tight protective garment as claimed in claim 8 a chemical proof zipper structure interposed in the wall of said garment and extending about the waist area of said tubular torso covering portion and transversely through said longitudinally extending elastic strip members affixed to the inner surface thereof.

10. In an air tight protective garment as claimed in claim 8 a chemical proof zipper structure interposed in the wall of said garment and extending longitudinally of said torso covering portion from said neck opening intermediate the elastic strip members of one of said third and fourth pairs thereof.

* * * * *